US006196705B1

(12) United States Patent
Finke et al.

(10) Patent No.: US 6,196,705 B1
(45) Date of Patent: Mar. 6, 2001

(54) HALOGEN MOTION DETECTION SECURITY LIGHT POSITIONING SYSTEM

(75) Inventors: Ralph Finke, Guethesloh; Thomas Franke, Schloss-Holte, both of (DE)

(73) Assignee: Steinel GmbH & Co. KG (DE)

( * ) Notice: Subject to any disclaimer, the term of this patent is extended or adjusted under 35 U.S.C. 154(b) by 0 days.

(21) Appl. No.: 09/370,716

(22) Filed: Aug. 9, 1999

(51) Int. Cl.[7] ..... F21V 23/00
(52) U.S. Cl. ..... 362/276; 362/371; 362/426
(58) Field of Search ..... 362/265, 276, 362/371, 426, 802

(56) References Cited

U.S. PATENT DOCUMENTS 3,519,811 * 7/1970 Jacobs ..... 362/426
5,649,761 * 7/1997 Sandell et al. ..... 362/276
5,662,411 * 9/1997 Haslam et al. ..... 362/276
5,941,630 8/1999 Finke et al. ..... 362/371

* cited by examiner

*Primary Examiner*—Stephen Husar
(74) *Attorney, Agent, or Firm*—Kinney & Lange, P.A.

(57) ABSTRACT

A halogen motion detection security light positioning system comprising a base, a yoke and a housing. The yoke having a crossbar and a pair of opposed facing prongs that extend from opposite ends of the crossbar. The yoke being rotatably connected at the crossbar to the base by a frictional securing mechanism. The housing has a halogen receptacle and is rotatably connected between the opposed facing prongs of the yoke by a self-locking securing mechanism that prevents rotation in an unflexed state and allows rotation in a flexed state.

50 Claims, 8 Drawing Sheets

HALOGEN MOTION DETECTION SECURITY LIGHT POSITIONING SYSTEM

BACKGROUND OF THE INVENTION

This invention pertains to a halogen light fixture. More particularly, it pertains to a halogen motion detection security light positioning system.

The use of light fixtures has become a popular choice to effectively deter unwanted activity and increase security for either commercial or private property. Motion detector security lights have become particularly useful for this purpose as described in U.S. patent Ser. No. 08/909,226, now U.S. Pat. No. 5,941,630. However, for the security lights and sensors to be effective, they must be properly positioned.

The popularity of security lights has steadily increased, and halogen security lights represent a continually larger portion of the security light market. Halogen lights provide a greater illuminance than the typical filament style light bulb for the same wattage rating and typically provide a more diffuse area of illumination. Halogen lights can cover a greater area than typical filament style lights, or spot lights, that have been used in the past. Halogen lights also provide a more efficient use of energy by providing greater illuminance for the same amount of energy. Halogen lights also maintain their light output level throughout the life of the lamp and readily achieve a lamp life of two thousand hours.

Halogen lights are typically mounted within a yoke type of mounting frame that includes a crossbar and a pair of opposed facing prongs that extend from opposite ends of the crossbar. The halogen light housing is usually mounted between the prongs of the yoke. Typically, the halogen housing is secured to the prongs by some type of a setscrew that may be either hand tightened or require use of a screwdriver, a wrench or a specially made tool. When the setscrew is loosened, the halogen light housing can rotate about its connection points to the prongs. Once the housing is properly positioned relative to the prongs, the setscrew is tightened locking the halogen light housing in place.

Positioning the halogen housing can be especially difficult because it typically requires loosening the setscrews between the halogen housing and the prongs, positioning the halogen housing as desired, and then tightening each setscrew for each of the prongs of the yoke one at a time. The halogen housing will tend to rotate, especially when the first setscrew is being tightened. This process generally requires assistance from another individual who can hold the housing in place while the setscrew is being tightened.

Once the housing is properly positioned and secured relative to the prongs of the yoke, then the crossbar of the yoke is secured or mounted to a base or another structure so that the halogen light illuminates a desired area. The crossbar typically can rotate about its connection point in a plane generally perpendicular to the rotational plane of the housing. Similar to the housing, the crossbar is also generally secured in place by a tightened setscrew.

A significant disadvantage to a setscrew design is the required use of additional tools to properly position the fixture. Typically, either a screwdriver, pliers, allen wrench or specially produced tool is required to secure the housing in place and properly position the light emitted by the fixture. The set screw is also generally located in a position that is not readily accessible, which further complicates the adjustment process. This requires the installer to hold the yoke or housing in place with one hand while using the other hand to tighten down the screw with some type of tool.

Passage of time and exposure to the elements tends to alter or change the positioning of the yoke or halogen housing, and hence the area illuminated by the halogen light fixture. Another disadvantage of the setscrew design is that exposure to the elements can cause corrosion and rust to form in the set screw mechanism. This leads to an undesired repositioning of the yoke or housing or makes future adjustments difficult, if not impossible. To re-obtain the desired coverage of light, the yoke or housing will have to be readjusted provided exposure has not ruined the respective positioning mechanisms.

Motion sensors are also more commonly being incorporated into halogen lights. Motion sensors are generally placed within the base of the halogen housing or near the light itself and have limited if any adaptability. A pair of screws are generally placed at a bottom of the unit to allow adjustment of the burn time, or length of time the light remains energized once activated, and to adjust for the luminance or lux necessary to activate the light. Typically, the screw heads are accessed through holes in the bottom of the base and are adjusted by a screwdriver to their desired settings. There are generally no markings on the screwheads to indicate their respective levels.

Motion sensors can also be affected by temperature. As the temperature cools down, the sensitivity of the sensor increases and the sensor is able to monitor greater distances. The greater sensitivity may undesirably increase the number of false detections which cause activation of the fixture and decrease the efficiency of the system. This is generally corrected by adjusting the settings of the screwheads, if they are provided, at the bottom of the base of the light fixture as the temperature changes over the course of the year. The screwhead settings thus require constant tweaking over seasonal changes to try to maintain the same general area of coverage. The detection area of the sensor has also been alterable by placing a piece of plastic over a face of the sensor to act as a cover or shroud.

BRIEF SUMMARY OF THE INVENTION

The present invention is a self-contained adjustable halogen light fixture. The fixture comprises a base, a yoke, and a housing. The yoke is secured to the base by a frictional securing mechanism and the housing is secured to the yoke by a self-locking securing mechanism. The yoke includes a crossbar and a pair of opposed facing prongs which extend in an upward direction from opposite ends of the crossbar. The crossbar of the yoke is rotatably connected to the base by the frictional securing mechanism. The frictional securing mechanism maintains the position of the yoke with respect to the base until a rotational force is applied. The housing is rotatably secured between the prongs of the yoke by the self-locking securing mechanism. The self-locking securing mechanism maintains the position of the housing with respect to the yoke in an unflexed state. Applying sufficient rotational force to the housing about its connection points to the prongs will place the connection points into a flexed state and allow rotation between the housing and the opposed facing prongs. Upon loss of sufficient rotational force, the connection points will return to an unflexed state and again secure the housing relative to the pair of opposed facing prongs of the yoke.

The invention can also include a sensor having a semi-circular cover. The sensor is rotatably connected to the base by a second frictional securing mechanism independent of the housing or the yoke. The sensor includes adjustment dials to alter the performance of the fixture. An alterable shroud is also included with the sensor to cover-up desired portions of the semi-circular cover to define a customized detection area for the sensor.

DETAILED DESCRIPTION

Figure 1:
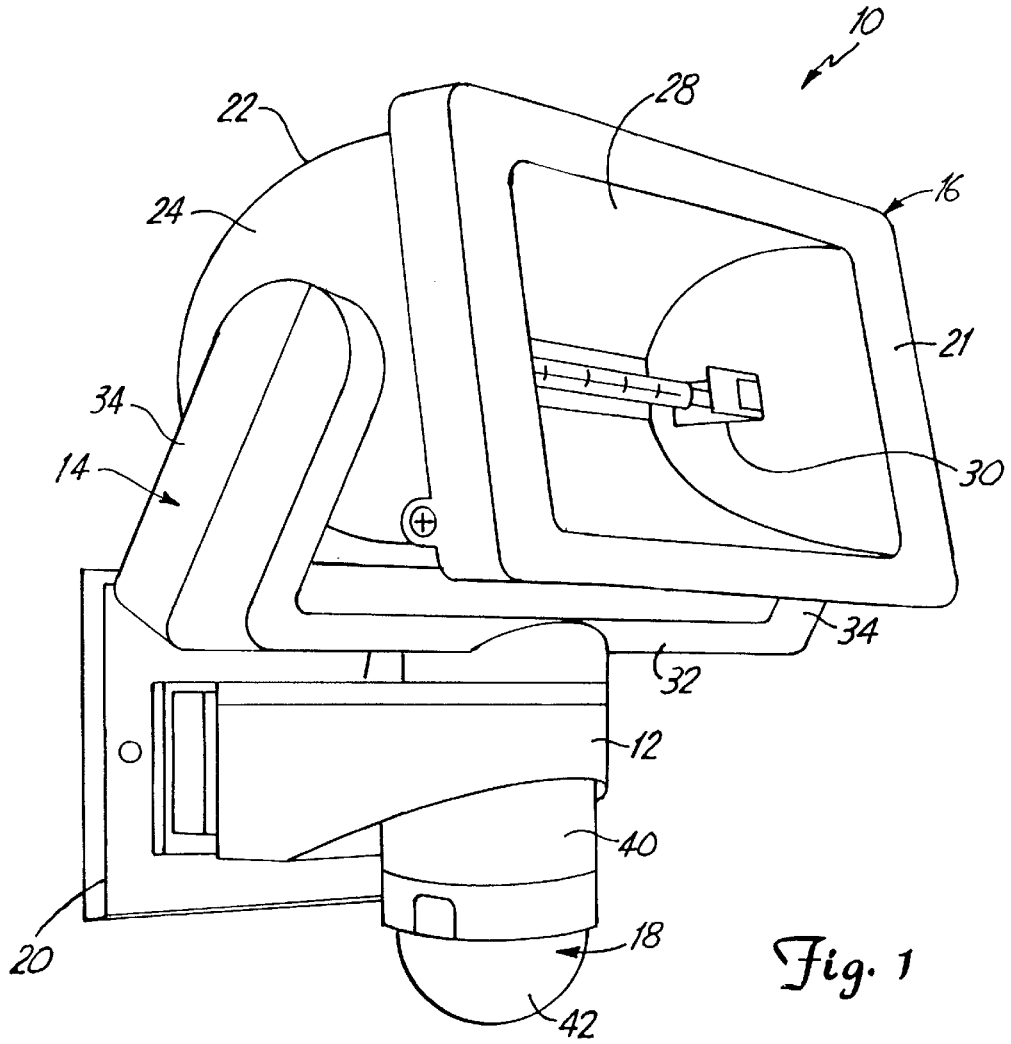
FIG. 1 is a perspective view of a preferred embodiment of the invention.

FIG. 1 is a perspective view of a preferred embodiment of a halogen motion detection security light positioning system 10. The halogen light 10 includes a base 12, a yoke 14, and a housing 16. The halogen light 10 can also include a sensor 18. In a preferred embodiment, the housing 16 is rotatably connected about its connection point to the yoke 14. Similarly, the yoke 14 is rotatably connected about its connection point to the base 12. The base 12 preferably provides a mounting plate 20 for securing the halogen light 10 to a structure, such as a side of a building or a light pole. The sensor 18 is also rotatably connected to the base 12 and preferably extends from the base 12 in a direction opposite to the yoke 14.

The yoke 14 preferably includes a crossbar 32 and a pair of opposed facing prongs 34. The prongs 34 extend upward from opposite ends of the crossbar 32. The housing 16 preferably includes a front cover plate 21, a back cover 22, and a left and a right sidewall 24 and 26, respectively. Behind the front cover plate 21, the housing 16 includes a reflector 28 and a receptacle 30. In a preferred embodiment, the reflector 28 is white and is made of ceramic. The front cover plate 21 is partially made of glass to allow light beams to exit the housing 16. The housing 16 is rotatably connected about its connection points to the yoke 14. The connection points are between the left and right sidewalls 24 and 26 and the opposed facing prongs 34. The yoke 14 is preferably connected at a midpoint of the crossbar 32 to a top of the base 12.

The sensor 18 preferably extends from the base 12 in a direction opposite to the yoke 14. The sensor 18 is preferably rotatable about its connection point to the base 12. The sensor 18 preferably includes an annular extension 40 that extends from and below the base 12 to a semi-circular cover 42. The cover 42 protects electronics that are contained within the sensor 18.

Figure 2:
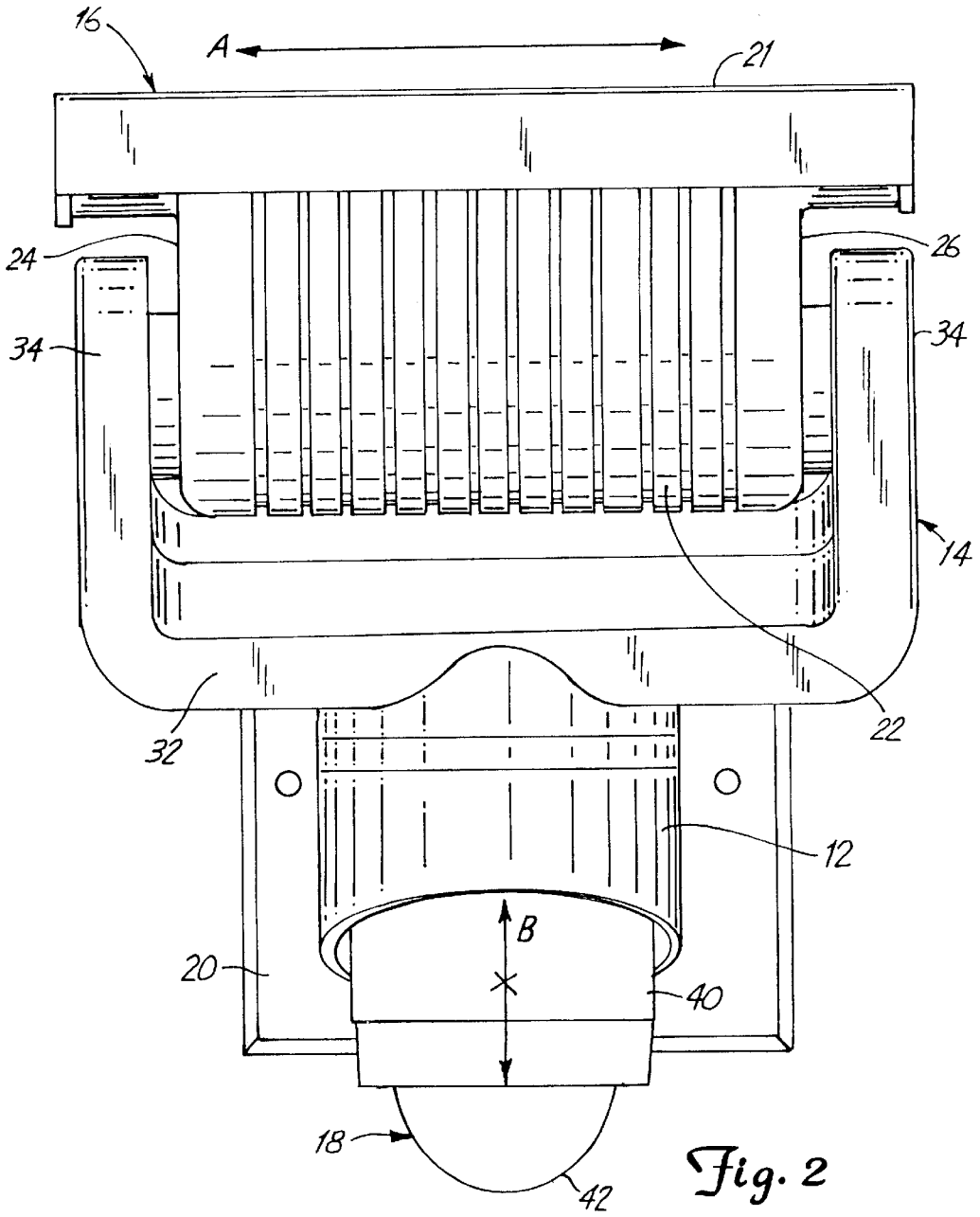
FIG. 2 is a front view of the preferred embodiment of the invention with a yoke and a sensor directed straight ahead and a front of a housing directed skyward.

FIG. 2 is a front view of a preferred embodiment of the invention illustrating the multiple-axis of rotation for the halogen light 10. In FIG. 2, the housing 16 is positioned so that its front cover plate 21 is pointed directly upward and is parallel to a horizontal plane through line A. This view more clearly shows the yoke 14 and particulary the prongs 34. The yoke 14 is positioned straight ahead or so that the crossbar 32 is perpendicular to a vertical plane that symmetrically divides the base 12 in half, includes a line B and is perpendicular to the horizontal plane. The sensor 18 is similarly pointed directly out or straight ahead from the mounting surface 20 of the fixture 10. An "X" is placed at the front center of the annular extension 40 to illustrate rotation of the sensor 18.

Figure 3:
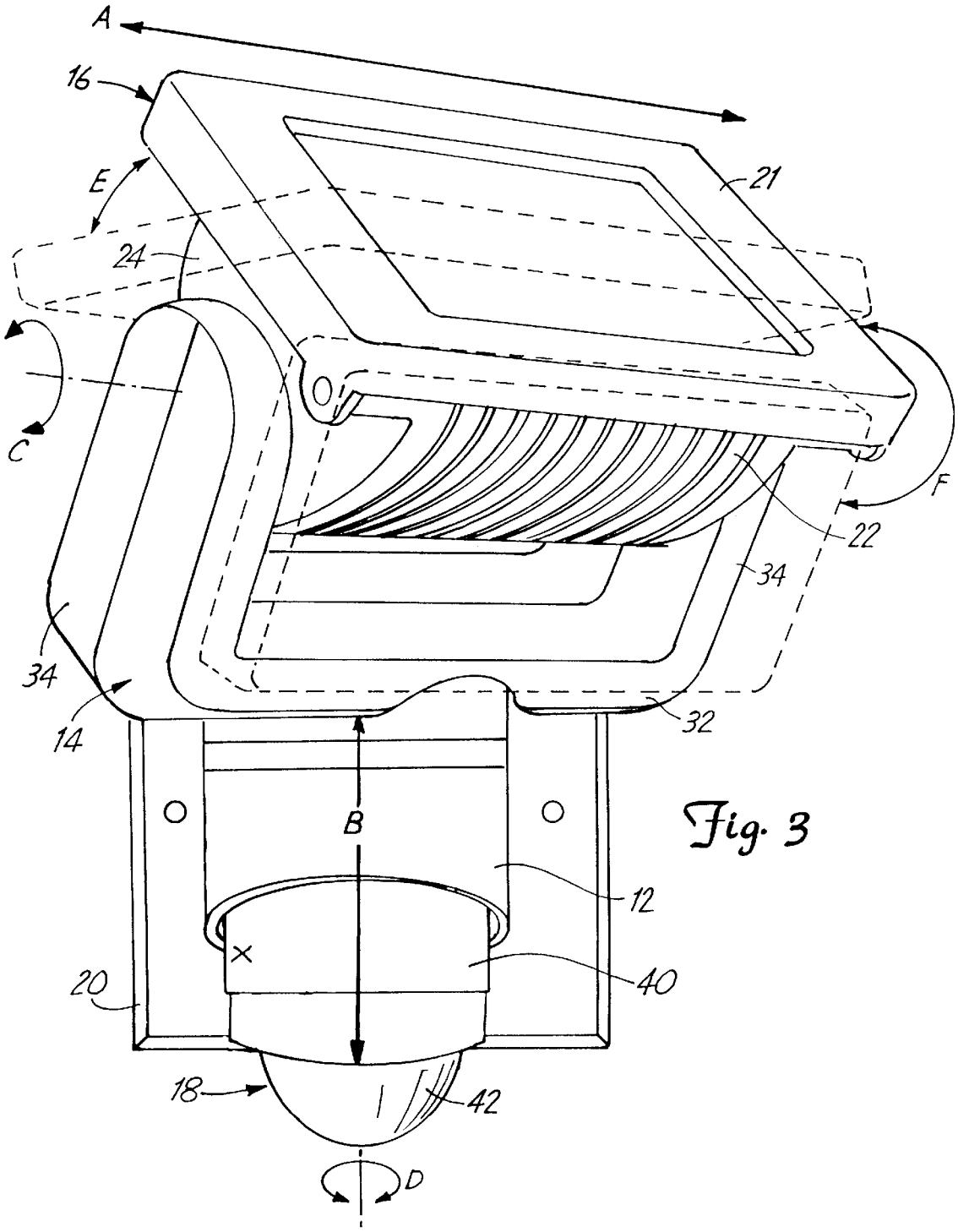
FIG. 3 is a front view of the preferred embodiment of the invention illustrating the independent rotation by the yoke being turned to the right, the sensor turned to the left, and the housing directed at an upward angle.

FIG. 3 is a front view of the halogen light fixture 10 illustrating its independent axis of rotation by comparing it to FIG. 2. In FIG. 3, the housing 16 is rotated so as to create an angle of approximately 45 degrees from the horizontal plane through the line A. The housing 16 rotates about an axis C through its connection point to the yoke 14. The housing 16 preferably rotates from approximately minus 20 degrees to 130 degrees from the horizontal plane that includes line A, or approximately from 110 degrees to minus 40 degrees from a vertical plane through its connection points that is perpendicular to the horizontal plane. The front cover plate 21 of the housing 16 is also shown in phantom at its preferred rotational limits. Curved line E represents the required rotation of the housing 16 to rotate the cover plate 21 from its position in FIG. 3 to the rotational limit of minus 20 degrees below the horizontal plane through line A, or of 110 degrees from the vertical plane through the housing's 16 connection points. Curved line F represents the required rotation of housing 16 to rotate the cover plate 21 from its position in FIG. 3 to the rotational limit of 130 degrees from the horizontal plane through line A, or of minus 40 degrees from the vertical plane through the housing's 16 connection points.

The yoke 14 in FIG. 3 has also been rotated independent of the housing 16. As illustrated in FIG. 3, the yoke 14 is rotated to the right. In a preferred embodiment, the yoke 14 rotates a maximum of approximately 40 degrees left or right of the vertical plane though line B and the base 12. The yoke 14 is shown rotated approximately 40 degrees to the right in FIG. 3. The yoke 14 rotates about an axis D through the center of its connection point to the base 12.

In addition to the housing 16 and the yoke 14, the sensor 18 has also been rotated in FIG. 3 as compared to FIG. 2. The sensor 18 has been rotated approximately 80 degrees to the left in FIG. 3 as compared to FIG. 2. The sensor 18 in FIG. 3 thus is directed toward the left, rather than straight ahead as in FIG. 2, as illustrated by the location of the "X" on the annular extension 40 being directed toward the left. The sensor 18 also rotates about its connection point to the base 12 about axis D. Although the yoke 14 and the sensor 18 rotate about the same axis D, each of their rotations is independent of the other.

Figure 4:
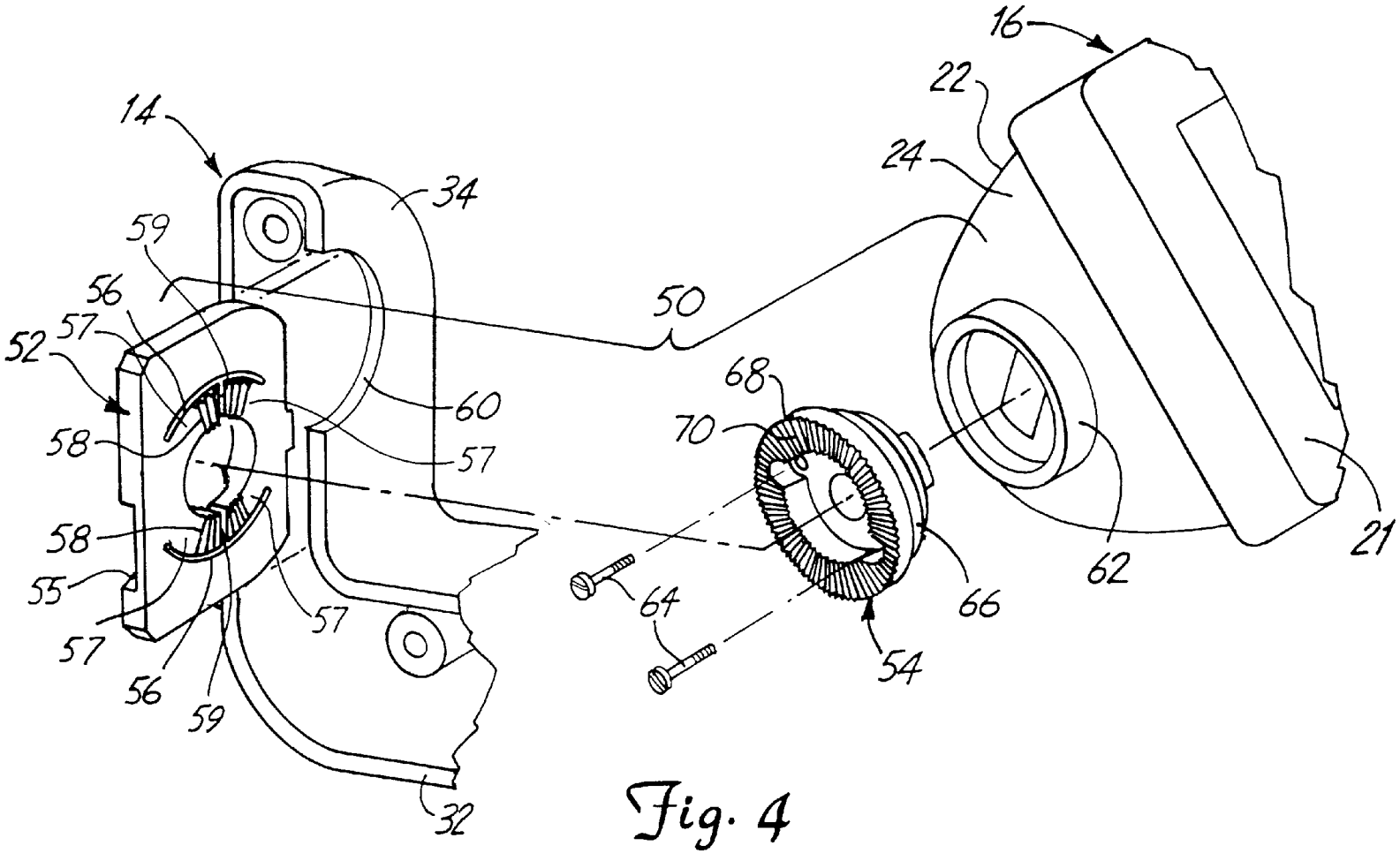
FIG. 4 is an exploded view of the connection at the left side of the invention between the housing and the yoke.

FIG. 4 is an exploded view of the connection between the yoke 14 and the housing 16. The yoke 14 is preferably made of a front piece and a back piece that are secured together. In FIG. 4, the front piece of the yoke 14 has been removed. Due to the symmetry of the device, only the left connection point between the yoke 14 and the halogen housing 16 will be described. In a preferred embodiment as shown in FIG. 4, a self-locking securing mechanism 50 connects the housing 16 to the yoke 14. The housing 16 is connected to the yoke 14 in a manner that allows for rotation about the connection points therebetween.

The self-locking securing mechanism 50 is comprised of a retaining plate 52 and an annular extension 54. The retaining plate 52 has a slotted circular pattern 56 cut through it with a pair of slits 59 that create a plurality of fingers 57 around the retaining plate's 52 open center. A series of raised notches 58 are placed along the fingers 57, preferably on either side of the slit 59 and in a radial pattern. There are preferably four of the fingers 57 on each of the retaining plates 52 as shown in FIG. 4. In a preferred embodiment, the raised notches 58 are serrated or have a triangular shape that extends outwards or above the otherwise flat surface of the retaining plate 52. The retaining plate 52 preferably sits in a slot formed within the prongs 34.

Along the facing or inner surface of the opposing prongs 34 is a through hole 60 that is aligned with the retaining plate 52 when it is secured within the opposing prongs 34. The through hole 60 receives the annular extension 54 mounted to the left and right sidewalls 24 and 26, respectively.

The annular extension 54 is preferably secured in a seat 62 of the left and right sidewalls 24 and 26, respectively, by a set of screws 64. Once secured to the seat 62, the annular extension 54 creates a groove 66 between the seat 62 and the opposite end of the annular extension 54 that is unconnected to the housing 16. The groove 66 has a smaller outer radius compared to the unconnected end of the annular extension 54 and the seat 62. The annular extension 54 further includes a radial end surface 68 at its unconnected end. A series of notches 70 are arrayed around the radial end surface 68 in a radial pattern. The notches 70 are preferably serrated or triangular in shape.

The groove 66 of the annular extension 54 fits in and is aligned with the through hole 60 in the prongs 34. The through hole 60 captures the end of the annular extension 54 beyond the groove 66 within the prongs 34. Once placed in the through hole 60, the annular extension 54 and the radial end surface 68 are aligned with the slotted circular pattern 56 on the retaining plate 52. In particular, the series of notches 70 on the radial end surface 68 are aligned and intermesh with the raised notches 58 on the fingers 57 of the retaining plate 52.

A recess 55 is placed on the retaining plate 52 on a side opposite the notches 58. The recess 55 provides a pathway for a set of electrical wires 71, as shown in FIG. 5, to pass from within the yoke 14, through the open centers of the retaining plate 52 and the annular extension 54, and into the housing 16 for connection to the receptacle 30.

The series of notches 58 on the fingers 57 are preferably raised so as to extend from the otherwise flat surface of the retaining plate 52. The series of notches 58 are also preferably only placed at the end of the fingers 57, or centered around the slits 59 of the slotted circular pattern 56. The fingers 57 allow for a degree of annular displacement with respect to the rest of the retaining plate 52. By placing the series of notches 58 at the end of the fingers 57, or centered around the slits 59, the notches 58 can be annularly displaced when an annular compressive force is applied against them. Also, raising the series of notches 58 on the retaining plate 52 makes the contact point between the annular extension 54 and the retaining plate 52 the raised series of notches 58 and the series of notches 70. Otherwise, the contact point would be along the flat surface of the slotted circular pattern 56 preventing the series of notches 58 and 70 from intermeshing. It would also inhibit rotation of the housing 16 by not allowing for the annular displacement of the fingers 57, or the displacement of at least a portion of the slotted circular pattern 56. This is because the contact surface would be across the entire slotted circular pattern 56 and any annular force applied would be distributed evenly across the entire slotted circular pattern 56.

Figure 5:
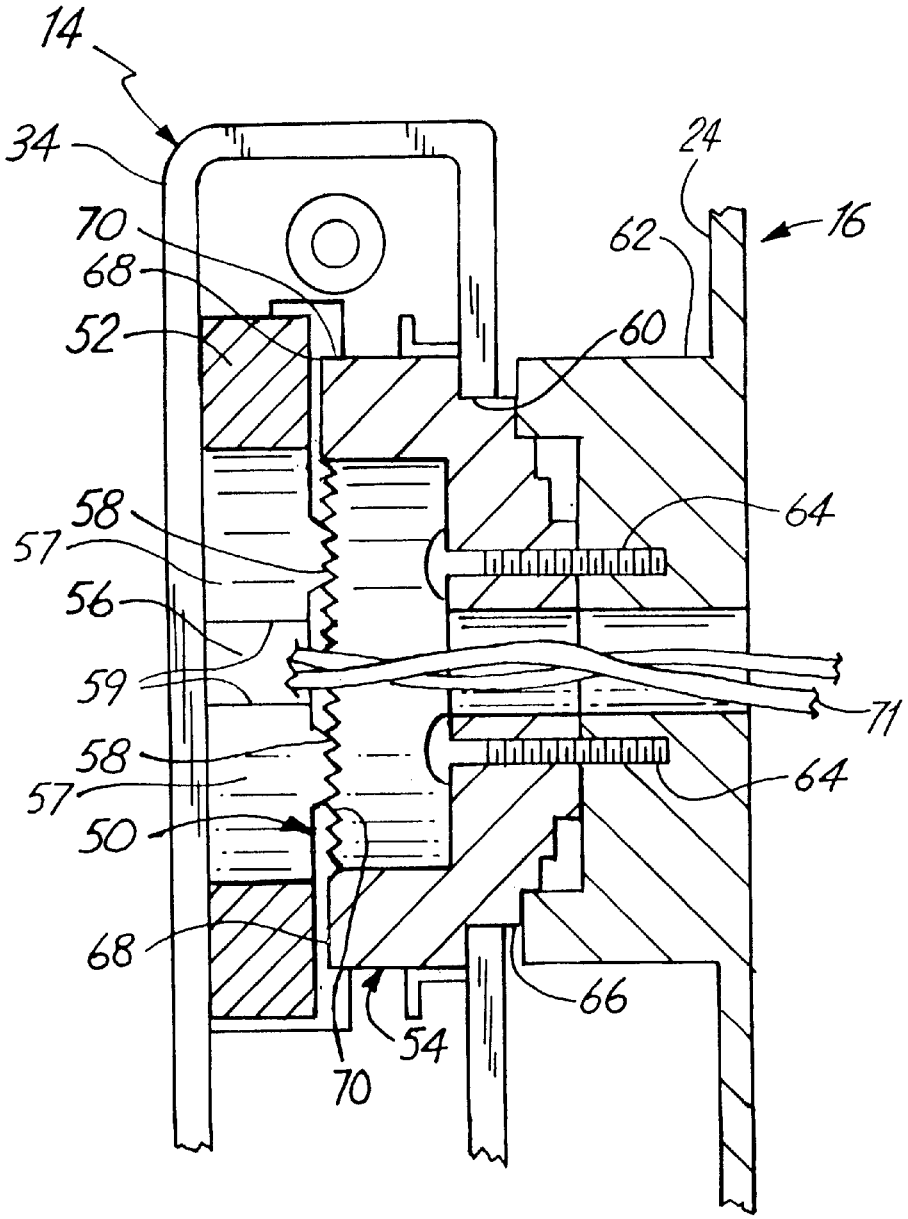
FIG. 5 is a top sectional view of the connection at the left side of the invention between the housing and the yoke.

FIG. 5 shows a top sectional view of the connection between the yoke 14 and the housing 16 by removing the front piece of the yoke 14. In FIG. 5, it is seen that the groove 66 is secured in the through hole 60 of the prong 34, thereby retaining the housing 16 within as well as between the prongs 34 of the yoke 14. Extending out from the groove 66 is the unconnected end of the annular extension 54. The radial end surface 68 at the unconnected end of the annular extension 54 includes the series of notches 70 which align and intermesh with the series of raised notches 58 placed on the fingers 57 of the retaining plate 52.

The set of electrical wires 71 are shown passing through the open centers of the retaining plate 52 and the annular extension 54. The open centers provide an electrical channel for the wires 71 to pass through from the yoke 14 to the housing 16 to provide electrical power to the receptacle 30.

As illustrated in FIG. 5, the notches 58 are preferably centered on the slits 59 placed in the slotted circular pattern 56 to create the plurality of fingers 57. The slit 59 is shown at the bottom center of the retaining plate 52 that is held within the prong 34 in FIG. 5. However, the slit 59 and the slotted circular pattern 56 could alternatively be placed anywhere around the retaining plate's 52 open center.

Placing the notches 58 at the ends of the fingers 57, or centered on the slits 59, and raising them makes the primary point of contact between the retaining plate 52 and the annular extension 54 between the notches 58 and 70, respectively. In an unflexed or at rest state the retaining plate 52 and annular extension 54 are interlocked in position relative to one another by the notches 58 and 70, respectively. The interlocked or intermeshed connection between the notches 58 and 70 prevents movement of the housing 16 (to which the annular extension 54 is secured), relative to the prongs 34 of the yoke 14, (which secures the retaining plate 52). The housing 16 is thereby locked into place relative to the yoke 14.

As a result of placing the series of notches 58 at the end of the fingers 57 or centered on the slits 59 of the retaining plate 52, a compressive force against the notches 58 will cause the fingers 57 to detent or deflect away from the force. The compressive force against the notches 58 can also be applied by a rotational force from the notches 70 of the annular extension 54 against the notches 58. The rotational force is applied to the housing 16 for its rotation with respect to the yoke 14. The rotational force is in part transferred by the series of notches 70 of the annular extension 54 into a compressive force against the series of notches 58 located on the retaining plate 52 causing an outward annular displacement of the fingers 57. As the rotational force is translated into a compressive force, the raised series of notches 58 no longer remain intermeshed with the series of notches 70 and allow rotation of the housing 16 with respect to the yoke 14. The translated compression force that separates the notches 58 from the notches 70 for rotation therebetween places the self-locking securing mechanism 50 into a flexed state. Upon loss of the rotational force applied to the housing 16, such as when the fixture 10 is properly directed, the connection point between the retaining plate 52 and the annular extension 54 is returned to an unflexed state. The notches 58 again intermesh or interconnect with the notches 70 locking the housing 16 into place with the yoke 14 as the fingers 57 return to their normal at rest and unflexed position.

Figure 6:
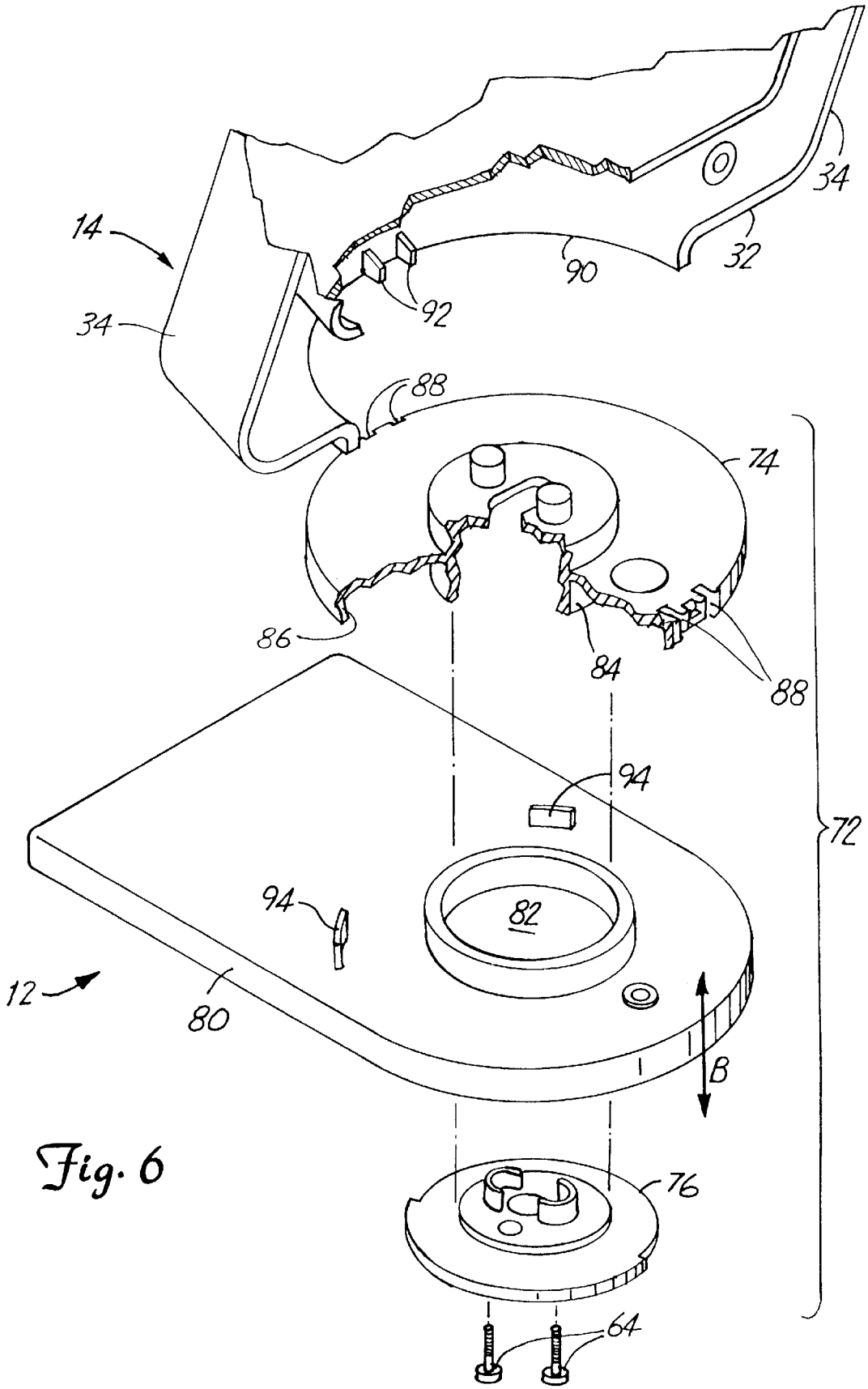
FIG. 6 is an exploded and partial broken view of the invention between the yoke and the base.

FIG. 6 is an exploded and partial broken view of the connection between the yoke 14 and the base 12. In particular, FIG. 6 includes a frictional securing mechanism 72 which is comprised of a top plate 74 and a bottom plate 76. The top plate 74 is connected to the bottom plate 76 by a set of screws 64 through an opening 82 in a top cover 80 of the base 12. The top plate 74 thus secures itself to the base 12 by connecting to the bottom plate 76 through the opening 82 of the top cover 80. The top plate 74 includes an inner annular ring 84 which extends in a downward direction from the top plate 74 and has a diameter similar to the opening 82 in the top cover 80. The outer surface of the inner annular ring 84 contacts the top cover 80 along the radial surface that creates the opening 82. The top plate 74 extends beyond the inner annular ring 84 to create an outer annular ring 86. A series of slots 88 are placed along an outer surface of the outer annular ring 86 at a front and a back of the top plate 74. The outer annular ring 86 does not extend in a downward direction as far as the inner annular ring 84. Rather, the outer annular ring 86 sets atop the top cover 80 when the inner annular ring 84 is inserted into the opening 82.

Centered at the bottom of the crossbar 32 of the yoke 14 is an aperture 90. The aperture 90 fits around and encloses the outer annular ring 86 of the top plate 74. A set of fingers 92 extend radially inward from the inner surface of the aperture 90 in the front and the back. Due to symmetry, only the back set of fingers 92 on the back piece of the yoke 14 are shown in FIG. 6. However a corresponding similar pair of fingers 92 extend radially inward from the front piece of the yoke 14. The fingers 92 mate with and are inserted into the slots 88 placed along the front and the back of the top plate 74. Once the front and back pieces of the yoke 14 are secured together, its relative position with the top plate 74 is maintained by the fingers 92 that are inserted into the slots 88. The yoke 14 then rotates as the top plate 74 rotates about the top cover 80 of the base 12.

As described above, the front and back pieces of the yoke 14 are secured together to capture the top plate 74 in the aperture 90. The top plate 74 is then secured to the bottom plate 76 through the opening 82 in the top cover 80. In a preferred embodiment screws 64 secure the bottom plate 76 to the top plate 74. By tightening the screws 64, a greater compressive force is applied to the top plate 74 pulling it in a downward direction, such that the outer annular ring 86 contacts the top cover 80 with greater force. The end result is that a greater rotational force is required about the connection point between the top plate 74 and the bottom plate 76 to rotate the top plate 74 and bottom plate 76 about the top cover 80 of the base 12. Hence, a greater force is required to rotate the yoke 14 that is secured to the top plate 74. The top plate 74 and bottom plate 76 also preferably include an opening through their centers to provide a channel for the set of wires 71 to pass through from the base 12 to the yoke 14.

A pair of stop surfaces 94 extend vertically upwards from the top cover 80 of the base 12. The stop surfaces 94 are contained within the top plate 74 just inside an inner surface of the outer annular ring 86. The stop surfaces 94 contact the back mounting slot 88 positioned along the outer annular ring 86 at the back of the top plate 74. When the stop surfaces 94 contact the back slot 88, into which the fingers 92 of the aperture 90 of the yoke 14 are inserted, they limit the rotation of the top plate 74 with respect to the top cover 80 and thus limits rotation of the yoke 14. with respect to the base 12. In a preferred embodiment, the stop surfaces 94 contact the slot 88 at the back of the top plate 74 at approximately 40 degrees on either side of the vertical plane through line B, or allow approximately 80 degrees of rotation about the front center of the base 12.

Figure 7:
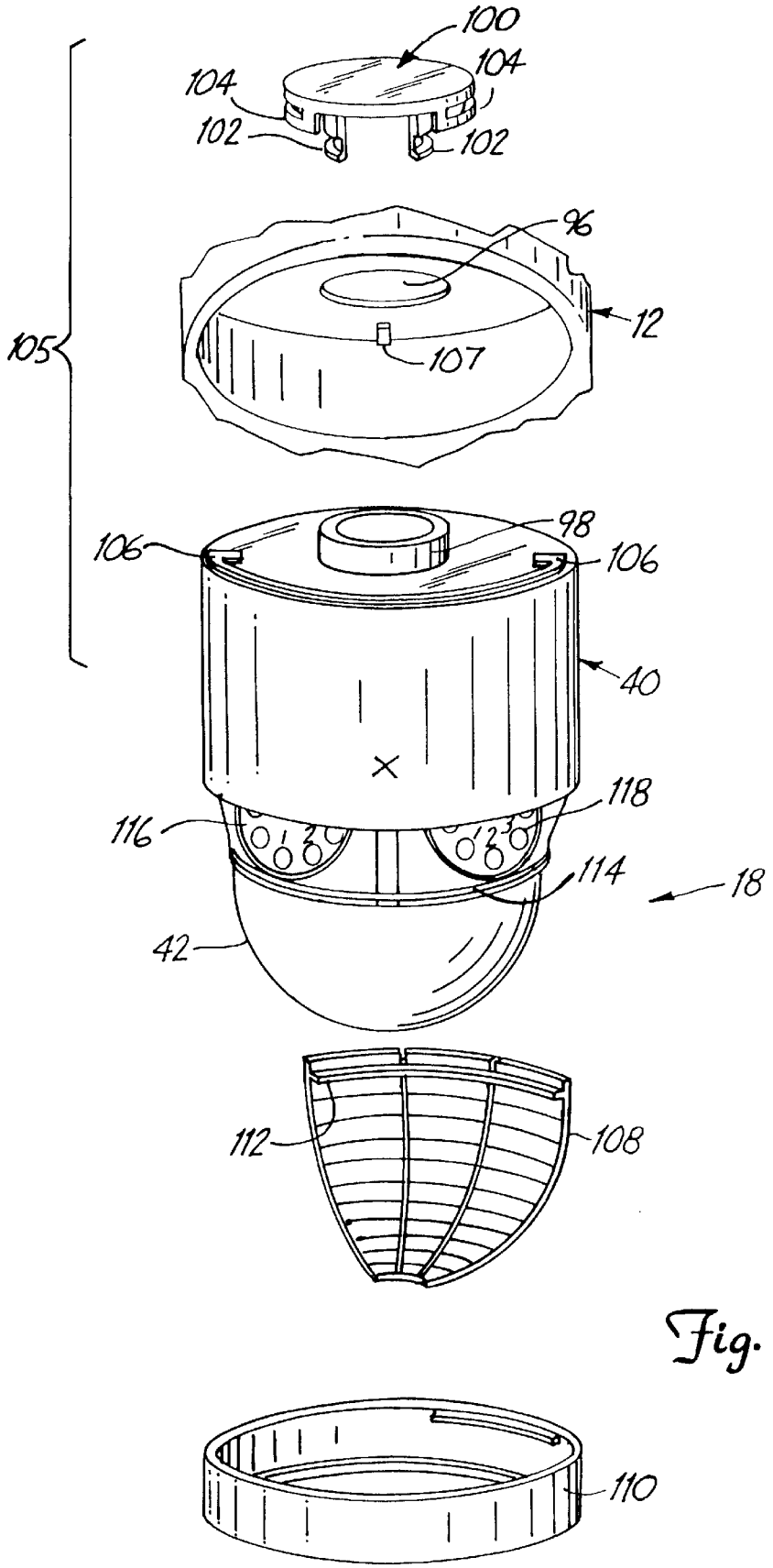
FIG. 7 is an exploded view of the sensor controls and a shroud.

FIG. 7 is an exploded view of the sensor 18 and its connection to the base 12. The base 12 includes a passage 96 through which an annular stem 98, which extends in an upward direction from the annular extension 40 of the sensor 18, is inserted. A retaining clamp 100 has a pair of inner annular posts 102 which extend downward in an annular direction beyond a second pair of outer annular posts 104. The inner annular posts 102 clip within the annular stem 98 that extends from the annular extension 40 of the sensor 18. The outer annular posts 104 contact the base 12 around the passage 96 suspending the sensor 18 from the base 12.

The retaining clamp 100 secured within the annular stem 98 creates a second frictional securing mechanism 105 that rotatably secures the sensor 18 to the base 12. A stop wall 106 is placed on a portion of the top of the annular extension 40 of the sensor 18 along the surface which contacts the base 12. The ends of the stop wall 106 contact a stop post 107 placed on the base 12 to allow rotation by the sensor 18 of approximately 80 degrees in either direction from the center of the base 12, or of approximately 160 degrees about the front center of the base 12. The "X" has again been placed on the front center of the annular extension 40 for orientation purposes.

The sensor 18 includes a receiver that is housed within the semicircular cover 42. The receiver preferably detects thermal radiation with pyroelectric infrared sensor technology. The receiver is electrically powered by a set of electrical wires that pass beneath a top of the retaining claim 100 and through the annular stem 98 into the annular extension 40.

In a preferred embodiment, the inner surface of the semi-circular cover 42 is dimpled to provide improved detection coverage over a desired area. The dimples placed along the semi-circular cover 42 help avoid distortion of a signal as it passes through the semi-circular cover 42. Placing dimples across the surface of the semi-circular cover 42 creates approximately 250 windows that pass the signal to the receiver without distortion over an approximately 240 degree radial area of detection. The semi-circular cover 42 is also preferably curve molded to prevent distortion of the semi-circular cover 42 when it is secured in place, rather than the conventional technique of flat molding which tends to introduce distortions in the plastic material used to create the semi-circular cover 42.

A shroud 108 can be placed over a portion of the semi-circular cover 42 to customize the area of detection for the sensor 18. An attachment ring 110 secures the shroud 108 over the semi-circular cover 42. A lip 112 at the top of the shroud 108 fits within a groove 114 to assist in maintaining the position of the shroud 108 over the semi-circular cover 42. In a preferred embodiment, the shroud 108 has a scored surface to assist in altering its shape. The score lines preferably create equivalent longitudinal sections and have latitudinal score lines equidistant apart. Removing portions of the shroud 108 allows customizing of the detection area.

The attachment ring 110 also covers a pair of sensor adjustment dials 116 and 118. The adjustment dial 116 alters the length of time that the halogen light 10 remains energized once activated by the sensor 18. In a preferred embodiment, the period of time the halogen light 10 remains energized will vary between approximately 10 seconds to 15 minutes. The sensor adjustment dial 118 is a lux or a luminance adjustment dial. The lux adjustment dial 118 varies the luminance level necessary to enable the sensor 18 to activate the halogen light 10. In a preferred embodiment, the lux adjustment dial 118 can vary between complete daylight to complete darkness. The adjustment dials 116 and 118 also preferably include a numbered scale to assist in adjusting there settings and the operation of the sensor 18.

Figure 8:
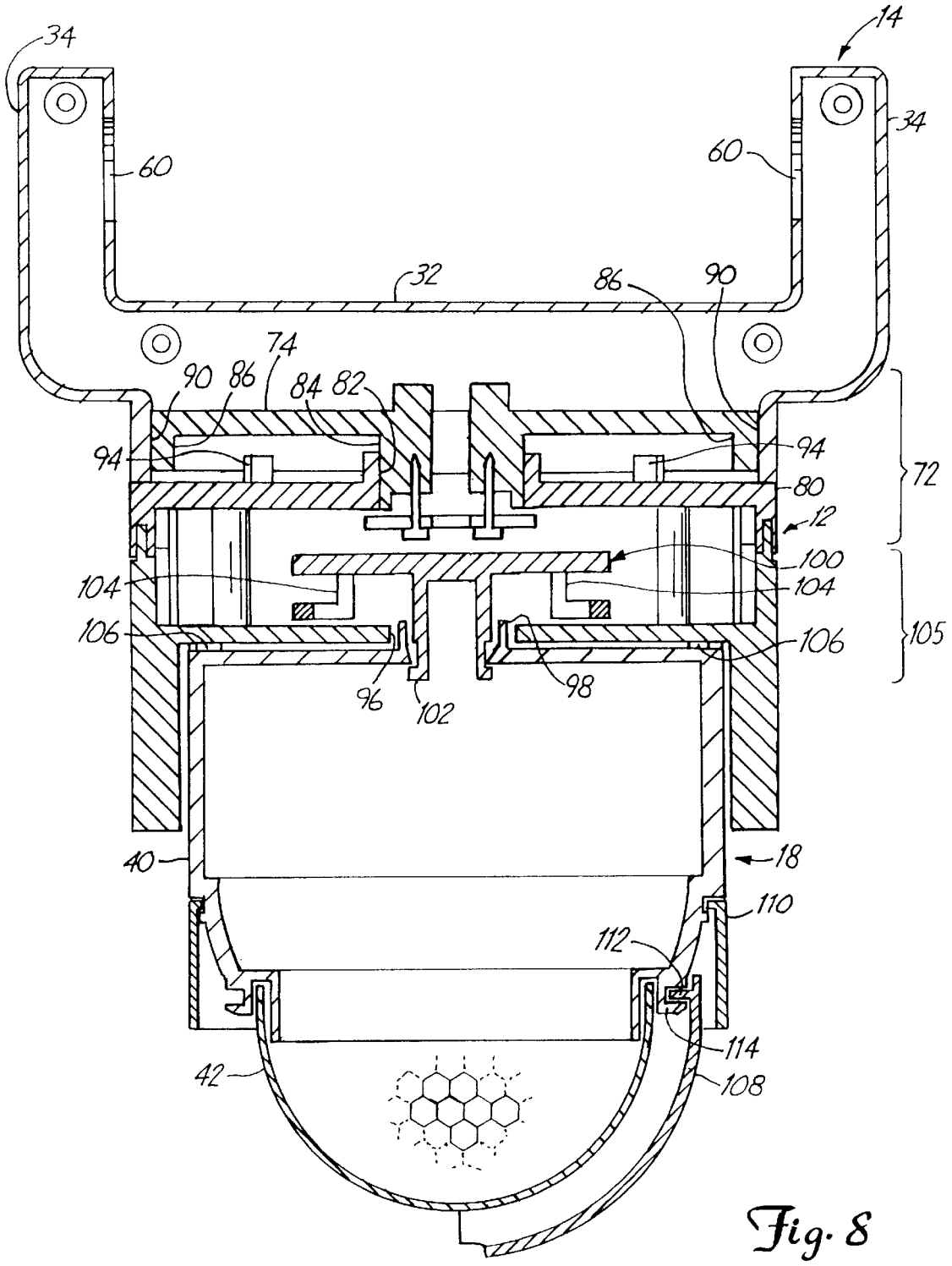
FIG. 8 is a sectional view of the invention illustrating the connection between the base and the yoke, and between the base and the sensor.

FIG. 8 provides a sectional view of the independent connections between the yoke 14 and the base 12, as well as the base 12 and the sensor 18. The front piece of the yoke 14, the retaining plates 52, the annular extensions 54 and the housing 16 are not shown in FIG. 8 for clarity and to simplify the drawing. In FIG. 8, the yoke 14 is rotatably connected to the base 12 by the frictional securing mechanism 72. The sensor 18 is suspended and rotatably connected to the base 12 by a second frictional securing mechanism 105 provided by the retaining clamp 100.

In FIG. 8, the yoke 14 is positioned straight ahead. FIG. 8 illustrates how the inner annular ring 84 fits within the opening 82 of the base 12. The outer annular ring 86 is also shown fitting within the aperture 90 of the yoke 14. Again, it is the set of fingers 92 that extend radially inward from the inner surface of the aperture 90 that interconnect with the slots 88 of the top plate 74 securing the yoke 14 to the top plate 74.

FIG. 8 also illustrates how the sensor 18 is suspended from the base 12 so that it is rotatable about its connection point to the base 12 by the second frictional securing mechanism 105. The sensor 18 is shown with its annular stem 98, from the annular extension 40, extending through the passage 96 of the base 12. The inner annular posts 102 of the retaining clamp 100 are inserted into the center of the stem 98 and clamp to a bottom of the stem 98. The retaining clamp 100 also includes the outer annular posts 104 which contact a bottom surface of the base 12 through which the passage 96 is formed. The outer annular posts 104 suspend the annular extension 40 from the base 12.

The semi-circular cover 42 is shown connected to the annular extension 40 at an end opposite to the base 12. The inside surface of the semicircular cover 42 is preferably dimpled, as shown over a portion of the inside surface in FIG. 8. The shroud 108 is shown covering a right side of the semicircular cover 42. The shroud 108 is secured by inserting the lip 112 of the shroud 108 into the groove 114. The attachment ring 110 then covers the shroud 108 and helps maintain the connection between the shroud 108 and the sensor 18.

A wire channel is provided by the open center sections of the top and bottom plates 74 and 76, respectively, as well as by the retaining clamp 100. The wire channel provides a path for the set of wires 71 to pass through and provide electricity to the various sections of the halogen light 10. In particular, the set of electrical wires 71 deliver electricity from the base 12, where it enters the halogen light 10, to the sensor 18 directly and to the receptacle 30 contained within the housing 16 via the yoke 14.

Although the present invention has been described with reference to preferred embodiments, workers skilled in the art will recognize that changes may be made in form and detail without departing from the spirit and scope of the invention. For example, the angular rotational limits can be adjusted. The adjustment dials can also be used for controlling other operational features of the sensor or the length of time or luminance level can provide alternative parameters. The sensor could also detect movement, noise or other occurrences in place of thermal radiation, or some combination thereof. The intermeshing notches of the self-locking securing mechanism can also have a different shape other than serrated. The frictional securing mechanism can also be constructed differently as illustrated by the connection between the yoke and the base and the sensor and the base.

What is claimed is:

1. A halogen motion detection security light positioning system, the halogen light comprising:

a base;

a yoke having a crossbar and a pair of opposed facing prongs which extend from opposite ends of the crossbar;

a frictional securing mechanism that rotatably connects the crossbar of the yoke to the base of the fixture, wherein the frictional securing mechanism maintains the position of the yoke until a rotational force is applied altering the position of the yoke;

a housing that encloses a halogen receptacle; and a self-locking securing mechanism that rotatably connects the housing to the prongs preventing rotation of the housing in an unflexed state and allowing rotation in a flexed state.

2. The halogen light of claim 1, wherein the crossbar of the yoke rotates approximately 80 degrees across a front of the base about its connection point to the base.

3. The halogen light of claim 1, wherein the housing can rotate vertically from approximately minus 20 degrees to 130 degrees from a horizontal plane through its connection points to the prongs of the yoke.

4. The halogen light of claim 1, wherein the self-locking mechanism includes:

a retaining plate having raised serrated teeth placed on a plurality of fingers created by an opening in a center of the plate, a slotted circular pattern placed on the plate, and a slit between the open center and slotted circular pattern, wherein the retaining plate is secured within the opposed facing prongs of the yoke; and an annular extension that extends out from opposite sides of the housing and includes a groove that secures the housing in a through hole of the opposed facing prongs, the annular extension having serrated teeth along a radial end surface that aligns and intermeshes with the raised serrated teeth placed on the plurality of fingers created on the retaining plate in an unflexed state.

5. The halogen light of claim 1, wherein the housing includes a ceramic reflector.

6. The halogen light of claim 1, wherein the halogen light includes a sensor within a semi-circular cover that extends from and rotates about the base to activate the halogen light.

7. The halogen light of claim 6, wherein the sensor detects thermal radiation with pyroelectric infrared sensor technology.

8. The halogen light of claim 6, wherein a plurality of dimples are placed on the semi-circular cover.

9. The halogen light of claim 6, wherein an alterable shroud can be placed over the semi-circular cover to customize a detection area of the sensor.

10. The halogen light of claim 9, wherein an attachment ring secures the shroud over the semi-circular cover of the sensor.

11. The halogen light of claim 6, wherein the sensor rotates over an area centered on the front of the base of approximately 160 degrees about its connection point to the base.

12. The halogen light of claim 6, wherein the sensor includes a pair of adjustment dials that alter the operation of the halogen light.

13. The halogen light of claim 12, wherein one adjustment dial is a time setting adjustment dial that alters a time duration that the halogen light remains energized once activated by the sensor and the other adjustment dial is a lux adjustment dial that alters a light threshold necessary to operate the sensor.

14. The halogen light of claim 13, wherein the time setting adjustment dial is set within a time range of about 10 seconds to 15 minutes.

15. The halogen light of claim 13, wherein the lux adjustment dial can vary over a range of full daylight to total darkness.

16. The halogen light of claim 12, wherein the adjustment dials are covered by the attachment ring.

17. The halogen light of claim 6, wherein the sensor includes an annular enclosure which extends from and is rotatably secured to the base by a retaining clip, the sensor and semi-circular cover being positioned at an opposite end of the annular enclosure than is secured to the base.

18. The halogen light of claim 6, wherein the sensor detects over a radial area of approximately 240 degrees.

19. A halogen motion detection security light positioning system, the halogen light comprising:

a base;

a yoke having a crossbar that is rotatably connected to the base and a pair of opposed facing prongs that extend upward from opposite ends of the crossbar;

a housing, enclosing a halogen receptacle, that is rotatably connected between the opposed facing prongs of the yoke; and a sensor having a pair of dials for adjusting the operation of the halogen light, wherein the sensor extends from and rotates about its connection point to the base.

20. The halogen light of claim 19, wherein the crossbar of the yoke rotates approximately 80 degrees across a front of the base about its connection point to the base.

21. The halogen light of claim 19, wherein the housing can rotate vertically from approximately minus 20 degrees to 130 degrees from a horizontal plane through its connection points to the prongs of the yoke.

22. The halogen light of claim 19, wherein the sensor detects thermal radiation with pyroelectric infrared sensor technology.

23. The halogen light of claim 19, wherein the sensor is enclosed by a semi-circular cover at an end of the sensor opposite to its connection point to the base.

24. The halogen light of claim 23, wherein a plurality of dimples are placed on the semi-circular cover.

25. The halogen light of claim 23, wherein an alterable shroud can be placed over the semi-circular cover to customize a detection area of the sensor.

26. The halogen light of claim 25, wherein the shroud is scored in equivalent longitudinal sections.

27. The halogen light of claim 25, wherein the shroud is scored in latitudinal sections that are equidistant apart.

28. The halogen light of claim 25, wherein an attachment ring secures the shroud over the semi-circular cover of the sensor.

29. The halogen light of claim 19, wherein the sensor rotates over an area centered on the front of the base of approximately 160 degrees about is connection point to the base.

30. The halogen light of claim 19, wherein one adjustment dial is a time setting adjustment dial that alters a time duration that the halogen light remains energized once activated by the sensor and the other adjustment dial is a lux adjustment dial that alters a light threshold necessary to operate the sensor.

31. The halogen light of claim 30, wherein the time setting adjustment dial is set within a time range of about 10 seconds to 15 minutes.

32. The halogen light of claim 30, wherein the lux adjustment dial can vary over a range of full daylight to total darkness.

33. The halogen light of claim 19, wherein the adjustment dials are covered by the attachment ring.

34. The halogen light of claim 19, wherein the sensor includes an annular enclosure which extends from and is rotatably secured to the base by a retaining clip, the sensor and semi-circular cover being positioned at an opposite end of the annular enclosure than is secured to the base.

35. The halogen light of claim 19, wherein the sensor detects over a radial area of approximately 240 degrees.

36. A halogen motion detection security light positioning system, the halogen light comprising:

a housing, enclosing a halogen receptacle, that is rotatably connected to a yoke which rotatably extends from a base;

a sensor having a semi-circular cover and adjustment dials to alter performance of the halogen light, the sensor being rotatably connected to the base; and an alterable shroud which screens a desired portion of the semi-circular cover of the sensor to define a customized detection area for the sensor.

37. The halogen light of claim 36, wherein the shroud is scored in equivalent longitudinal sections.

38. The halogen light of claim 36, wherein the shroud is scored in latitudinal sections that are equidistant apart.

39. The halogen light of claim 36, wherein the crossbar of the yoke rotates approximately 80 degrees across a front of the base about its connection point to the base.

40. The halogen light of claim 36, wherein the housing can rotate vertically from approximately minus 20 degrees to 130 degrees from a horizontal plane through its connection points to the prongs of the yoke.

41. The halogen light of claim 36, wherein the sensor detects thermal radiation with pyroelectric infrared sensor technology.

42. The halogen light of claim 36, wherein a plurality of dimples are placed on the semi-circular cover.

43. The halogen light of claim 36, wherein an attachment ring secures the shroud over the semi-circular cover of the sensor.

44. The halogen light of claim 36, wherein the sensor rotates over an area centered on the front of the base of approximately 160 degrees about is connection point to the base.

45. The halogen light of claim 36, wherein one adjustment dial is a time setting adjustment dial that alters a time duration that the halogen light remains energized once activated by the sensor and the other adjustment dial is a lux adjustment dial that alters a light threshold necessary to operate the sensor.

46. The halogen light of claim 45, wherein the time setting adjustment dial is set within a time range of about 10 seconds to 15 minutes.

47. The halogen light of claim 45, wherein the lux adjustment dial can vary over a range of full daylight to total darkness.

48. The halogen light of claim 36, wherein the adjustment dials are covered by an attachment ring.

49. The halogen light of claim 36, wherein the sensor includes an annular enclosure which extends from and is rotatably secured to the base by a retaining clip, the sensor and semi-circular cover being positioned at an opposite end of the annular enclosure than is secured to the base.

50. The halogen light of claim 36, wherein the sensor detects over a radial area of approximately 240 degrees.

* * * * *